US007848537B2

(12) United States Patent
Ishigaki et al.

(10) Patent No.: US 7,848,537 B2
(45) Date of Patent: Dec. 7, 2010

(54) VOICE COIL BOBBIN, MANUFACTURING METHOD THEREOF AND SPEAKER DEVICE

(75) Inventors: Toshihiro Ishigaki, Yamagata (JP); Yoshihide Goto, Yamagata (JP); Taiki Goto, Yamagata (JP); Shuji Higuchi, Tokyo (JP)

(73) Assignees: Pioneer Corporation, Tokyo (JP); Tohoku Pioneer Corporation, Tendo-shi, Yamagata (JP); Goto Denshi Co., Ltd., Sagae, Yamagata (JP)

( * ) Notice: Subject to any disclaimer, the term of this patent is extended or adjusted under 35 U.S.C. 154(b) by 1134 days.

(21) Appl. No.: 11/512,397

(22) Filed: Aug. 30, 2006

(65) Prior Publication Data

US 2007/0053546 A1 Mar. 8, 2007

(30) Foreign Application Priority Data

Aug. 30, 2005 (JP) ..... 2005-249232

(51) Int. Cl.
*H04R 1/00* (2006.01)
*H04R 9/06* (2006.01)
*H04R 11/02* (2006.01)

(52) U.S. Cl. ..... 381/407; 381/400

(58) Field of Classification Search ..... 381/396, 381/398, 400–407, 410, 433
See application file for complete search history.

(56) References Cited

U.S. PATENT DOCUMENTS

2003/0178112 A1* 9/2003 Takahashi et al. ..... 148/669

FOREIGN PATENT DOCUMENTS

| | | | |
|---|---|---|---|
| JP | 08-205285 | | 8/1996 |
| JP | 10-032897 | | 2/1998 |
| JP | 2002-088446 | * | 3/2002 |
| JP | 2002-222616 | | 8/2002 |
| JP | 2002-300697 | | 10/2002 |

* cited by examiner

*Primary Examiner*—Tuan D Nguyen
(74) *Attorney, Agent, or Firm*—Nixon & Vanderhye P.C.

(57) ABSTRACT

A voice coil bobbin is formed by skinpass rolling of pure titanium. A manufacturing method of a voice coil bobbin includes a process which manufactures a rolled pure titanium material, a process which executes skinpass rolling of the rolled material, and a process which forms the rolled material after the skinpass rolling to manufacture the voice coil bobbin. For example, the rolled pure titanium material is manufactured by a standard manufacturing process of a normal rolled material defined by JISH4600, and the cold rolling for the purpose of the strengthening is executed. The cold rolling is executed under a condition of a rolling ratio equal to or larger than 60%. Thereby, it becomes possible to obtain double hardness of JIS No. 1-kind titanium material (TR270C) and tensile strength larger than double of the JIS No. 1-kind titanium material (TR270C) and close to 6-4 titanium. By applying this thin voice coil bobbin with the high strength, the speaker device applicable for the high power input can be obtained.

2 Claims, 6 Drawing Sheets

FIG. 4

| KIND | THICKNESS | TENSILE TEST | | |
|---|---|---|---|---|
| | | TENSILE STRENGTH | PROOF STRESS | ELONGA-TION |
| | mm | $N/mm^2$ | $N/mm^2$ | % |
| No.1-KIND (TR270C) | EQUAL TO OR LARGER THAN 0.2 TO EQUAL TO OR SMALLER THAN 1.5 | 270~410 | EQUAL TO OR LARGER THAN 165 | EQUAL TO OR LARGER THAN 27 |
| No.2-KIND (TR340C) | EQUAL TO OR LARGER THAN 0.2 TO EQUAL TO OR SMALLER THAN 1.5 | 340~510 | EQUAL TO OR LARGER THAN 215 | EQUAL TO OR LARGER THAN 23 |

FIG. 5

MATERIAL COMPARISON

| | HARDNESS | TENSILE STRENGTH | THERMAL CONDUCTIVITY RATIO |
|---|---|---|---|
| | Hv | $N/mm^2$ | cal/cm·°C·sec |
| SKINPASS ROLLING TITANIUM (EMBODIMENT) | 240 | 750 | 0.041 |
| No.1-KIND TITANIUM (TR270C) | 120 | 340 | 0.041 |
| 6-4-KIND TITANIUM (Ti-6Al-4V) | 280 | 900 | 0.018 |
| HARD ALUMINUM (A5052) | 60 | 230 | 0.49 |

ELASTICITY

| BOBBIN MATERIAL | ELASTICITY |
|---|---|
| SKINPASS ROLLING TITANIUM (EMBODIMENT) t0.10 | 20 |
| No.1-KIND TITANIUM t0.10 (TR270C) | 10 |
| ALUMINUM t0.10 | 3 |
| PHENOL RESIN IMPREGNATION GLASS CROSS t0.075 | 1 |

VOICE COIL BOBBIN, MANUFACTURING METHOD THEREOF AND SPEAKER DEVICE

BACKGROUND OF THE INVENTION

1. Field of the Invention

The present invention relates to a manufacturing method of a voice coil bobbin for a speaker device.

2. Description of Related Art

It is known that a voice coil for a speaker device is formed by winding a wire around a voice coil bobbin (also simply referred to as "bobbin" hereinafter) of a film type or a pipe type (e.g., see Japanese Patent Applications Laid-open under No. 2002-300697, No. 8-205285 and No. 10-32897).

In addition, as a technique enabling high power input to a voice coil, there are known a technique of lapping a film material such as glassimide and polyimide film around the voice coil bobbin for plural times, and a technique of using a voice coil bobbin made of hard aluminum. Meanwhile, as the wire wound around the voice coil bobbin, a ceramic wire is known (see Japanese Patent Application Laid-open under No. 2002-222616, which is referred to as "Patent Reference-1" hereinafter).

In correspondence with recent improvement of heat resistance of a wire by the ceramic coating wire described in Patent Reference-1 and the like, high power input to the speaker device is significantly enhanced. Thereby, it happens that the wire falls from the bobbin at the time of the high power input operation and/or the bobbin is cut at a joint between the bobbin and the wire. Thus, it is necessary that the strength of the material of the bobbin is further enhanced in order to further improve high-power performance of the speaker device from now.

SUMMARY OF THE INVENTION

The present invention has been achieved in order to solve the above problems. It is an object of this invention to provide a voice coil bobbin whose strength is high and which is hardly broken at the time of high input, a manufacturing method thereof and a speaker device having the voice coil bobbin.

According to one aspect of the present invention, there is provided a voice coil bobbin formed by a titanium material which is produced by skinpass rolling of pure titanium. In addition, according to another aspect of the present invention, there is provided a manufacturing method of a voice coil bobbin, including: a process which manufactures a rolled pure titanium material; a process which executes, to the rolled material, skinpass rolling for obtaining predetermined strength; and a process which forms the rolled material after the skinpass rolling to manufacture the voice coil bobbin.

For example, the rolled pure titanium material is manufactured by a standard manufacturing process of a normal rolled material defined by JISH4600, and the skinpass rolling for the purpose of the strengthening is executed. The skinpass rolling is executed under a condition of a rolling ratio equal to or larger than 60%. Thereby, it becomes possible to obtain double hardness of JIS No. 1-kind titanium material (TR270C) and tensile strength larger than double of the JIS No. 1-kind titanium material (TR270C) and close to 6-4 titanium. By applying this thin voice coil bobbin with the high strength, the speaker device applicable for the high power input can be obtained.

BRIEF DESCRIPTION OF THE DRAWINGS

FIG. 4 is a table showing a mechanical characteristic of pure titanium;

FIG. 5 is a table showing a material comparative result of the skinpass rolling titanium and other metal;

DETAILED DESCRIPTION OF THE PREFERRED EMBODIMENTS

The preferred embodiment of the present invention will now be described below with reference to the attached drawings.

[Voice Coil Bobbin]

Figure 1A:
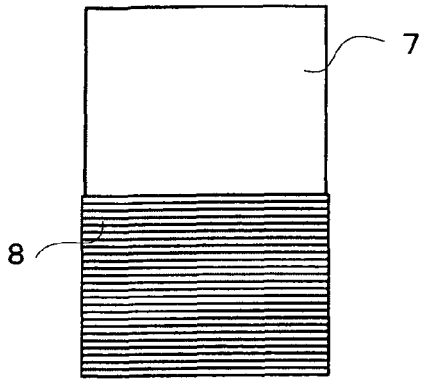
FIGS. 1A and 1B are schematic configuration views of a voice coil bobbin according to an embodiment.
Figure 1B:
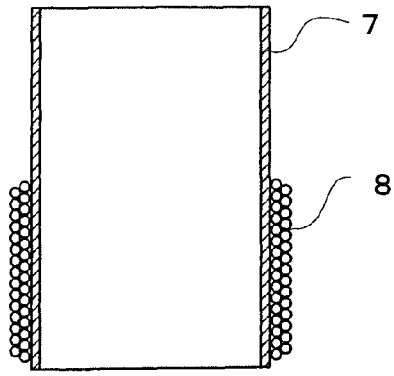

FIGS. 1A and 1B show configurations of the voice coil according to an embodiment. FIG. 1A is a side view of the voice coil, and FIG. 1B is a cross-sectional view including a center of the voice coil. As shown in FIGS. 1A and 1B, the voice coil includes a voice coil bobbin 7 formed into a hollow cylindrical shape and a wire 8 wound around an outer peripheral surface of a lower end side of the voice coil bobbin 7.

When improvement of durability of the voice coil bobbin is discussed, two points which will be described below become important.

(1) Tensile strength of a material (hereinafter also referred to as "bobbin material") forming the voice coil bobbin is large. It is required that the tensile strength of the bobbin material is large in order to withstand an up-down vibration operation with large magnitude and high speed.

Figure 2:
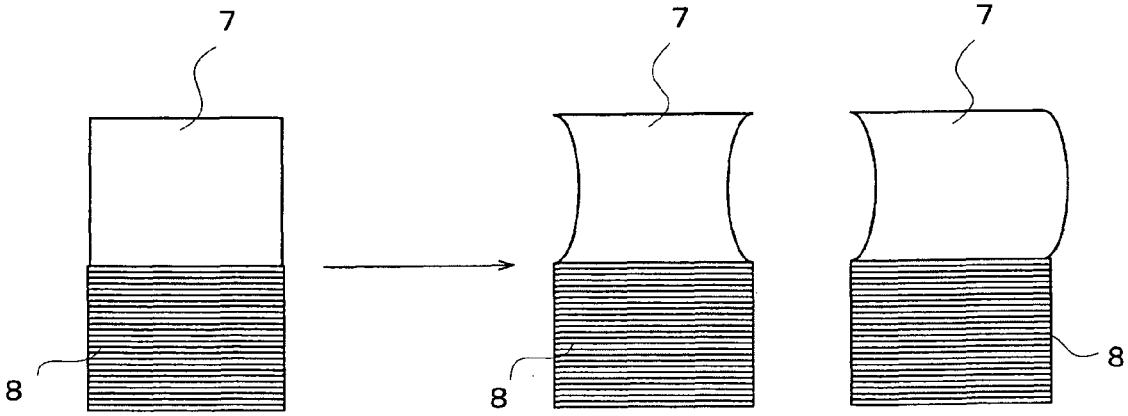
FIG. 2 is a diagram explaining a deformation of the voice coil bobbin at the time of high power input.

(2) Durability of the voice coil bobbin is superior. At the time of the high power input, the voice coil bobbin cannot withstand the power of the up-down operation occurring to the voice coil, and a shape of the voice coil bobbin is distorted during the vibration, as shown in FIG. 2. Therefore, a curving and folding force is generated between the wire and the voice coil bobbin, and the voice coil bobbin is cut due to the curving. Therefore, when the high power performance of the voice coil is intended, the curving strength of the voice coil bobbin is necessary.

In this embodiment, by improving the above-mentioned two points at the same time, the high power performance of the voice coil is realized. Concretely, the pure titanium is used for the bobbin material, and the pure titanium is worked and hardened by the skinpass rolling. Thereby, the strength is enhanced.

Currently, as a countermeasure against the cutting of the voice coil bobbin, an actual and most effective method is to use the high-strength titanium material for the bobbin material. However, "high-strength titanium material" is generally "titanium alloy", and the material is expensive. In addition, it is extremely difficult to obtain a thin material about 0.1 mm, and general versatility is insufficient. Further, since the thermal conductivity of the titanium alloy is low, the heat generated by the voice coil hardly radiate through the voice coil bobbin. Therefore, it easily happens that the voice coil is thermally broken.

Therefore, in this embodiment, the pure titanium (titanium No. 1-kind and titanium No. 2-kind) whose strength is enhanced by using the work and hardening by the skinpass rolling is used, in order to solve the problem.

Generally, methods of strengthening the titanium material are as follows.

(Method A) Oxygen and iron are added to the pure titanium.

(Method B) Strengthening by alloying (α alloy, α-β alloy and β alloy)

In the case of the pure titanium of the method A, ductility is reduced by adding the oxygen and the iron. As a result, a sheet material of the pure titanium industrially mass-manufactured with superior general versatility and availability is limited to the titanium No. 1-kind and the titanium No. 2-kind including the small amount of oxygen and iron due to a problem of the ductility or the deformability. However, in the case of the materials, when the bobbin thickness is set to equal to or smaller than 0.2 mm being within a practical range and thus the bobbin is used, the strength is insufficient as the bobbin material of the speaker having the maximum input larger than 3000 W. Therefore, the bobbin cutting occurs in the operation test. The strength equal to or larger than 600N/mm$^2$ is necessary in order to solve this problem. If the thickness is equal to or larger than 0.2 mm, the pure titanium is usable. However, the voice coil weight becomes heavy, which causes reduction of the output sound pressure.

On the other hand, the strengthening method B by the alloying is difficult to employ for the voice coil bobbin of the speaker device from the above-mentioned problems, i.e., "expensive", "insufficiencies of general versatility and availability" and "low thermal conduction".

Therefore, in the present invention, the pure titanium No. 1-kind TR270C and the pure titanium No. 2-kind TR340C are strengthened. Those materials come to have the same strength as the high strength alloy titanium (6-4 titanium) and the substantially same thermal conduction ratio as that of the standard material (TR270C) by the skinpass rolling process, and are standard and easily available.

[Manufacturing Process of Rolled Titanium Material]

Figure 3:
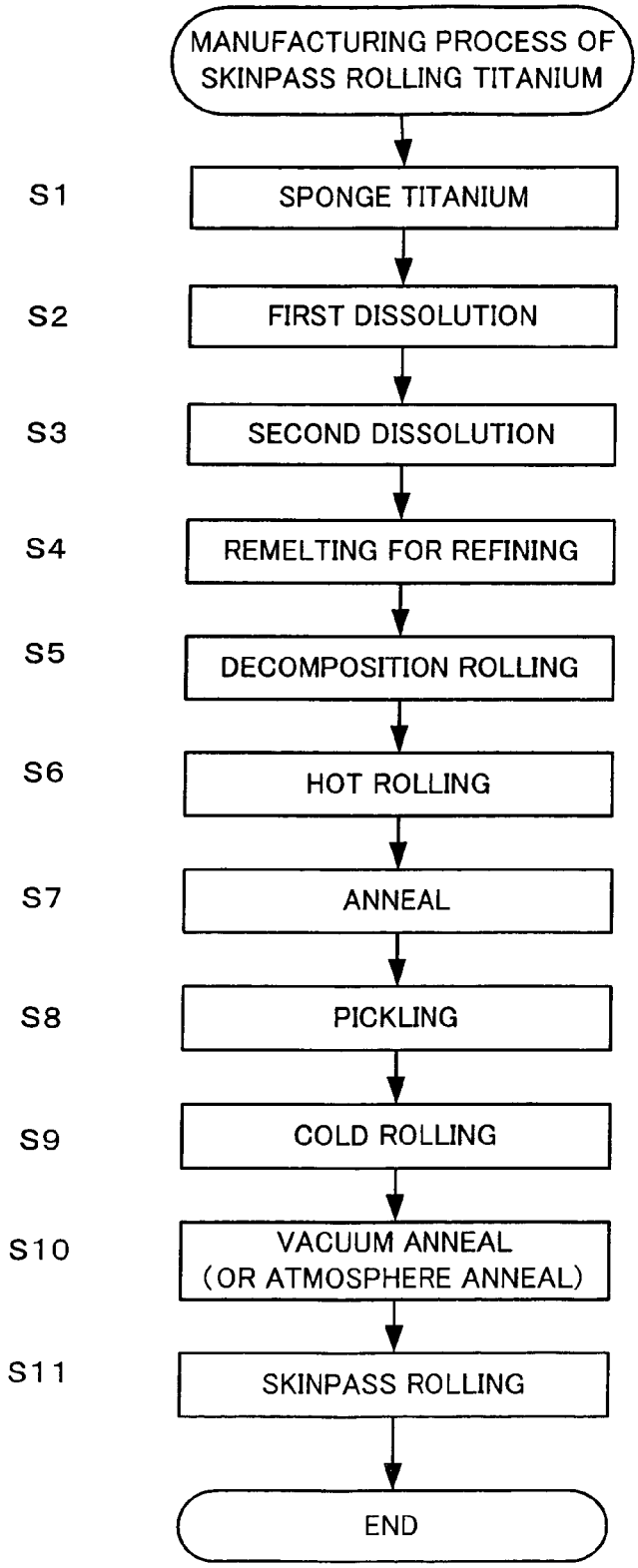
FIG. 3 shows a manufacturing process of skinpass rolling titanium according to the embodiment.

FIG. 3 shows a manufacturing process of a rolled titanium material according to this embodiment. Processes S1 to S10 are a standard manufacturing process of pure titanium No. 1-kind TR270C and No. 2-kind TR340 rolled materials. Meanwhile, a skinpass rolling process S11 for the purpose of strengthening is added. "Skinpass rolling for the purpose of strengthening" is a method of executing a vacuum anneal process S10, which is a final process of the standard manufacturing processes S1 to S10 of the rolled material defined by JISH4600, and then executing cold rolling under a condition of the rolling ratio equal to or larger than 60%. By this method, the tensile strength equal to or larger than 600N/mm$^2$ is obtained, without executing any special aging process. "Rolling ratio" is obtained by an equation below.

Rolling ratio=(board thickness before rolling−board thickness after rolling)/(board thickness before rolling)×100%

Now, JIS standard of the titanium is described. The pure titanium No. 1-kind TR270C and No. 2-kind TR340C are defined in Japanese Industrial Standard JISH4600 "Titanium and titanium alloy board and row". FIG. 4 shows a mechanical characteristic (abstract) of the material defined therein.

The mechanical characteristic defined in a table shown in FIG. 4 is a characteristic obtained by the vacuum anneal (or the atmosphere anneal) process (S10) being the final process in the standard manufacturing processes of the pure titanium No. 1-kind TR270C and No. 2-kind TR340C rolled materials shown in FIG. 3. This process executes anneal around 700 to 800° C. for the purpose of "reducing hardness increase due to inner distortion" and "recovering ductility and working property for recovering and recrystallization of a structure subjected to the rolling working", which are caused by the cold rolling process (S9) being the precedent process.

In the mechanical characteristic of JISH4600 shown in the table of FIG. 4, the tensile strengths of the pure titanium No. 1-kind TR270C and No. 2-kind TR340C are defined as 270 to 410N/mm$^2$ and 340 to 510N/mm$^2$, respectively.

FIG. 5 shows a material comparative result between other material and the titanium (hereinafter referred to as "skinpass rolling titanium" for convenience) to which the skinpass rolling (S11) according to the embodiment is executed. As shown in FIG. 5, the hardness Hv of the skinpass rolling titanium according to the embodiment is 240, which is twice as that of the JIS No. 1-kind titanium material (TR270C). In addition, the tensile strength of the skinpass rolling titanium is 750N/mm$^2$, which is larger than double strength of the JIS No. 1-kind titanium material (TR270C), and is close to strength of 6-4 titanium.

[Application to Speaker Device]

Figures 6, 7:
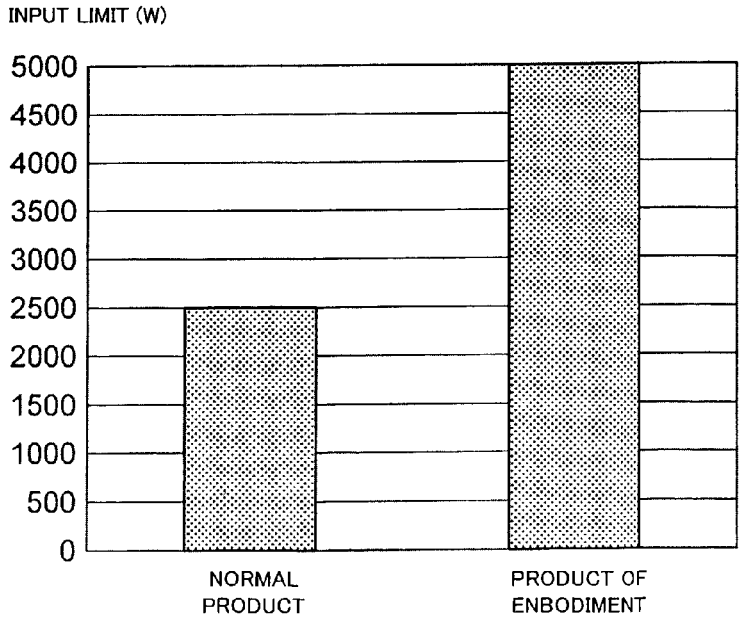
FIG. 6 is a table showing elasticity of the voice coil bobbin using the skinpass rolling titanium and the other material.
FIG. 7 is a graph showing a test result of input limits of voice coils of a normal product and the embodiment.

FIG. 6 shows a comparative result of the elasticity of the voice coil bobbin made of the skinpass rolling titanium according to the embodiment and the other material as the bobbin material. In items of "BOBBIN MATERIAL" shown in FIG. 6, "t0.10" shows thickness of 0.10 mm, and "t0.075" shows thickness of 0.075 mm. Additionally, in this measurement, there is executed such a test that a weight of 1 kg is attached to each of the bobbin materials cut into 25 mm width and the vibration at to-and-fro 180 degree (one-way 90 degree) is applied 30 times per minute, and the number of vibrations applied until the bobbin material is cut is measured. Namely, numeral values in items of "ELASTICITY" shown in FIG. 6 show the number of vibrations applied to the bobbin material until the bobbin material is cut. As understood by the numeral values, the skinpass rolling titanium according to the embodiment has largely improved elasticity as compared with the other bobbin material normally used and the No. 1-kind titanium.

FIG. 7 shows a comparative test result of input limits between the normal voice coil using hard aluminum as the bobbin material and the voice coil bobbin using the skinpass rolling titanium of this embodiment as the bobbin material.

(Test Condition)

Normal Voice Coil

Bobbin material: hard aluminum (thickness: 0.18 mm)

Wire: Ceramic coating wire (diameter ϕ: 0.55 mm, TOTOKU ELECTRIC CO., LTD PTSZSW)

Voice Coil According to Embodiment

Bobbin material: Skinpass rolling titanium (thickness: 0.15 mm)

Wire: Ceramic coating wire (diameter ϕ: 0.55 mm, TOTOKU ELECTRIC CO., LTD PTSZSW)

Speaker Diameter: 30 cm, Voice Coil Resistance: 4Ω

(Test Method)

Figure 8:
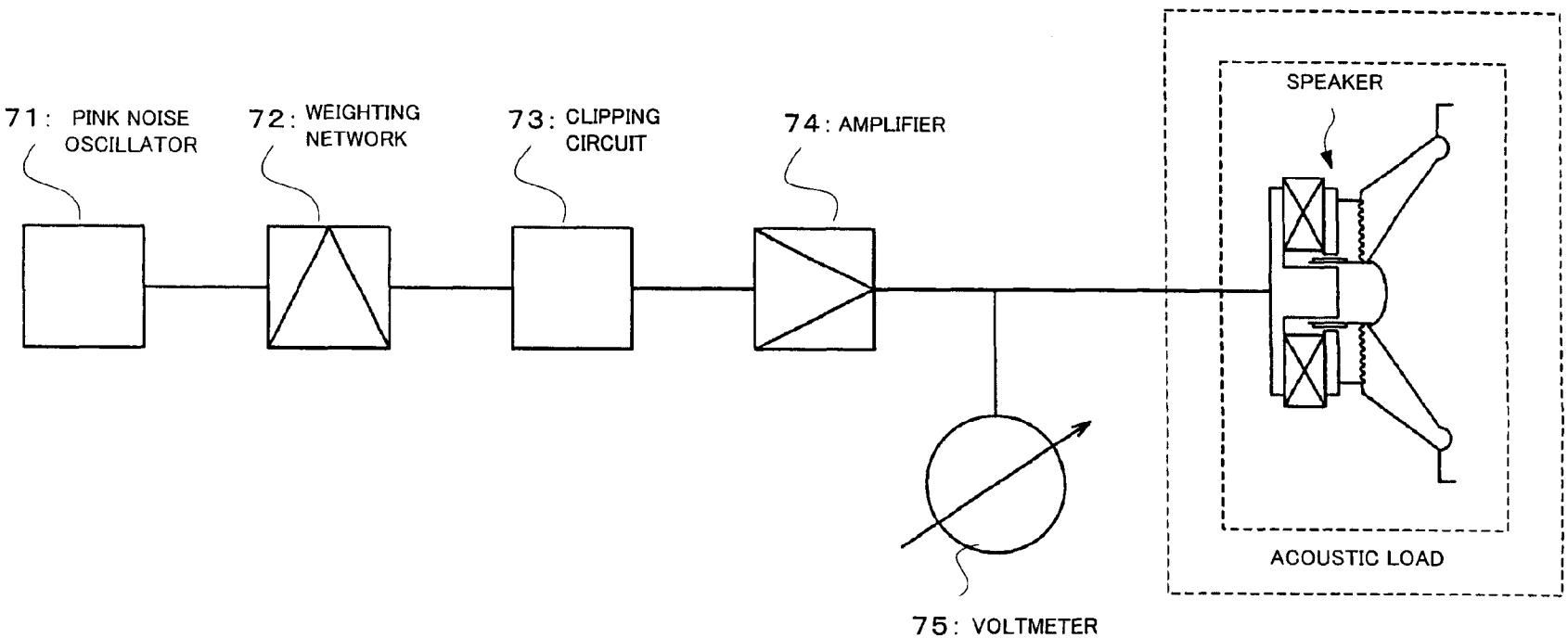
FIG. 8 is a diagram schematically showing a test method of the input limits of the voice coils of the normal product and the embodiment.

As shown in FIG. 8, a pink noise oscillator 71 generates a pink noise signal, and a weighting network 72 (in conformity with IEC268-1) generates a test frequency characteristic from the pink noise signal. The signal from the weighting network 72 is supplied to the speaker SP to drive it, a clipping circuit 73 and an amplifier 74. Thereby, the input power (input limit) at which the speaker is broken is examined.

(Test Result)

As for the voice coil bobbin (hard aluminum) being the normal product, the bobbin cutting occurred at the input power 2500 W. When the bobbin of the voice coil was changed to the skinpass rolling titanium of this embodiment, the bobbin cutting never occurred even at the input power 5000 W. Though the wire dropped from the bobbin at the input power equal to or larger than 5500 W, the bobbin cutting never occurred.

As described above, when the skinpass rolling titanium according to this embodiment is applied to the speaker, merits which will be described below can be obtained.

(1) Voice coil bobbin is hardly broken at the time of high power input.

As compared with TR270C, the hardness and the tensile strength of the skinpass rolling titanium of the present invention are twice and 2.2 times larger, respectively. In addition, as compared with the hard aluminum, the hardness and the tensile strength thereof are 4 times and 3.3 times larger, respectively. Thus, as compared with those bobbin materials, it becomes possible to withstand much higher input power.

(2) Voice coil bobbin can be thinner.

Since the hardness and the tensile strength are improved, the voice coil bobbin can be thinner than the standard titanium (TR270C). The specific gravity of the titanium is 4.5 $cm^3$, which is large. However, by making the thickness of the bobbin material thinner, the increasing of the specific gravity being a demerit of the titanium can be suppressed.

(3) Working property is also improved by making material thinner.

Additionally, in the case of the speaker for which the large power input making the voice coil bobbin cut is unnecessary, the thickness of the voice coil bobbin can be further thinner. By making the voice coil bobbin thin, the gap between the yoke and the plate of the magnetic circuit can be narrow, and efficiency of converting magnetic energy into kinetic energy is improved. In addition, since the distance between the voice coil and the yoke and the distance between the voice coil and the plate become close, the radiation effect is enhanced.

[Application Example to Speaker Device]

Figure 9:
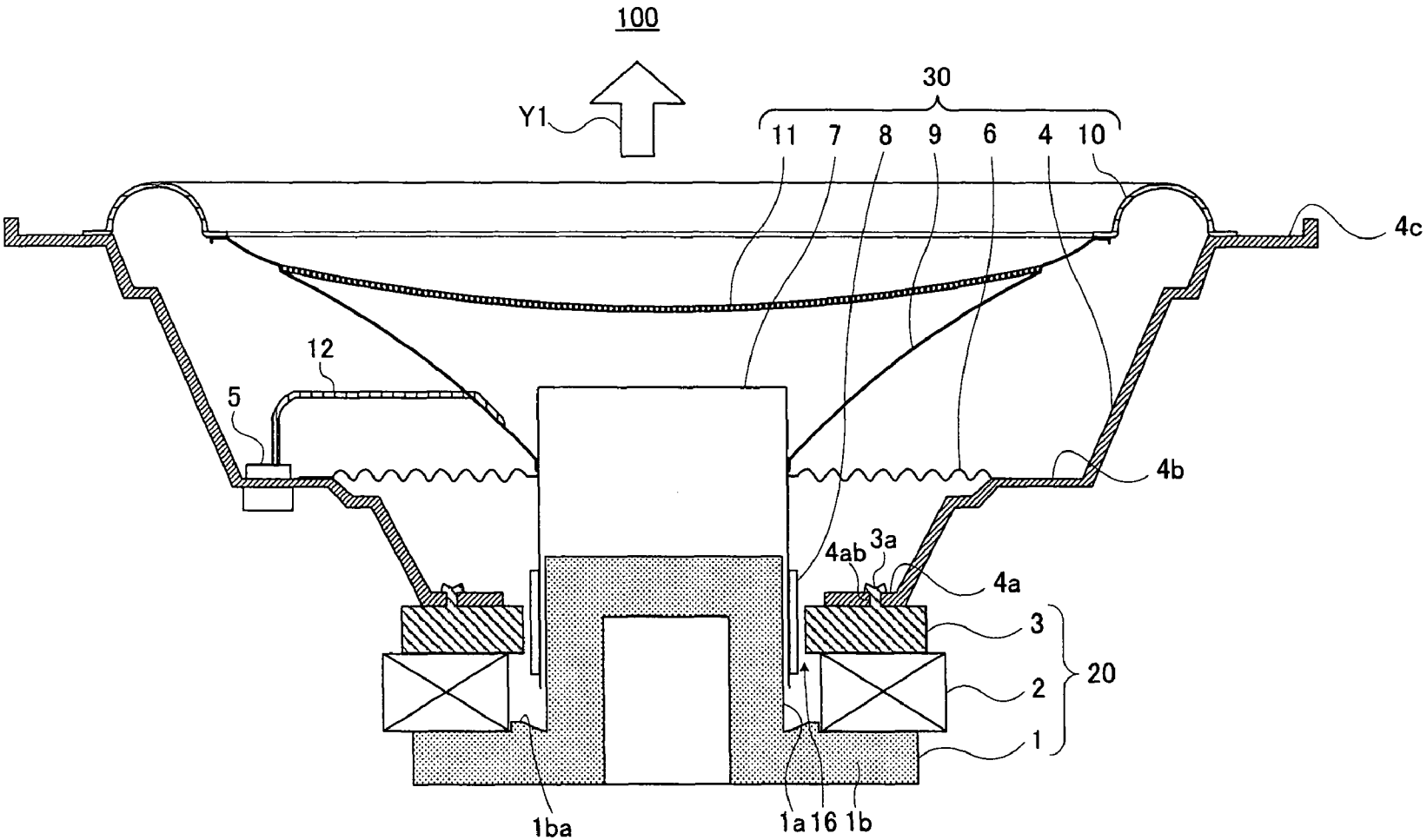
FIG. 9 is a schematic configuration view of the speaker device to which the skinpass rolling titanium is applied.

FIG. 9 schematically shows a configuration of the speaker device 100 to which the voice coil bobbin according to the embodiment of the present invention is applied. The speaker device 100 can be preferably used as an on-vehicle speaker. FIG. 9 shows a cross-sectional view cut along a plane including the central axis of the speaker device 100. Hereinafter, a description will be given of the configuration of the speaker device 100.

As shown in FIG. 9, the speaker device 100 mainly includes a magnetic circuit system 20 including a yoke 1, a magnet 2 and a plate 3, and a vibration system 30 including a frame 4, a damper 6, a voice coil bobbin 7, a wire 8, a diaphragm 9, an edge 10 and a cap 11, and various kinds of members including plural terminal members 5 and a tinsel cord 12.

First, a description will be given of each component of the magnetic circuit system 20.

The magnetic circuit system 20 is configured as a magnetic circuit in an external-magnet type. The yoke 1 has a pole part 1*a* formed into a substantially cylindrical shape and a flange part 1*b* outwardly extending from a lower end portion of an outer peripheral wall thereof. On an upper surface of an inner peripheral portion of the flange part 1*b*, a protruding part 1*ba* is formed. The protruding part 1*ba* has a function to position the magnet 2 at an appropriate position on the flange part 1*b*. The annular magnet 2, which is positioned at the appropriate position on the flange part 1*b* by the protruding part 1*ba* of the yoke 1, is fixed onto the flange part 1*b*. The annular plate 3 is fixed onto the annular magnet 2. In addition, on an upper surface of the annular plate 3, plural protruding parts 3*a* are formed. Each of the protruding parts 3*a* is formed in the circumferential direction of the annular plate 3 with an appropriate space therebetween. The plural protruding parts 3*a* have a function to position a first flat part 4*a* of the frame 4 at an appropriate position on the annular plate 3 and hold it. In the magnetic circuit system 20, the magnet 2 and the plate 3 form the magnetic circuit, and the magnetic flux of the magnet 2 concentrates on the magnetic gap 16 formed between the inner peripheral wall of the plate 3 and the outer peripheral wall of the pole part 1*a*.

Next, a description will be given of each component of the vibration system 30.

Various components of the speaker device 100 are fixed onto the frame 4, and the frame 4 has a function to support the components thereof. The frame 4 has a first flat part 4*a*, a second flat part 4*b* and a third flat part 4*c*, and upper surfaces thereof maintain flatness. The first flat part 4*a* has plural openings 4*ab* in the circumferential direction with appropriate spaces therebetween, and they are formed at positions on the lower side of the frame 4. Each of the correspondent protruding parts 3*a* of the plate 3 is inserted into each of the openings 4*ab*, and the upper side of each of the protruding parts 3*a* is caulked. Thereby, the first flat part 4*a*, which is positioned at the appropriate position on the annular plate 3, is fixed onto the annular plate 3. The second flat part 4*b* is formed at a substantially middle position of the frame 4. The outer peripheral edge portion of the damper 6 is mounted on the upper surface of the second flat part 4*b*. The third flat part 4*c* is formed at a position on the upper side of the frame 4. An outer peripheral edge portion of the edge 10 is mounted on the upper surface of the third flat part 4*c*.

The voice coil bobbin 7, which is manufactured by forming the above-mentioned skinpass rolling titanium, is formed into a substantially cylindrical shape. The wire 8 is wound around the vicinity of the lower end portion of the outer peripheral wall of the voice coil bobbin 7, which forms the voice coil. Preferably, the wire 8 is a ceramic coating wire. In addition, the vicinity of the lower end portion of the outer peripheral wall of the voice coil bobbin 7 is opposite to each of the inner peripheral walls of the annular magnet 2 and the plate 3 with a constant space. Meanwhile, the vicinity of the lower end portion of the inner peripheral wall of the voice coil bobbin 7 is opposite to the outer peripheral wall of the pole part 1*a* being the component of the yoke 1 with a constant space. A gap (magnetic gap 16) is formed between the outer peripheral wall of the pole part 1*a* and the inner peripheral wall of the plate 3.

The wire 8 has one lead wiring (not shown), which includes a plus lead wire and a minus lead wire. The plus lead wire is an input wiring for an L (or R)-channel signal, and the minus lead wire is an input wiring for a ground (GND: ground) signal. The lead wires are electrically connected to one end of each of the tinsel cords 12 drawn to the front side (sound output side) of the diaphragm 9, and other end of the tinsel cords 12 is electrically connected to one end side of each of the terminal members 5 positioned on the second flat part 4*b* of the frame 4. In addition, other end side of each of the terminal members 5 is electrically connected to each of the input wires of the amplifier. Therefore, 1-channel electric signal is inputted to the wire 8 from the amplifier via each of the terminal members 5, each of the tinsel cords 12 and each lead wiring.

The damper 6 formed into an annular shape has an elastic part on which corrugations are concentrically formed. The outer peripheral edge portion of the damper 6 is fixed onto the second flat part 4*b* of the frame 4. Meanwhile, the inner peripheral edge portion of the damper 6 is fixed onto the outer peripheral wall of the voice coil bobbin 7.

The material of the diaphragm 9 may be selected from paper, polymeric and metallic materials and other various materials according to one of various kinds of use. The inner peripheral edge portion of the diaphragm 9 is mounted in the vicinity of the inner peripheral edge portion of the damper 6 and in the vicinity of the upper end of the outer peripheral wall of the voice coil bobbin 7.

The edge 10 has a cross-sectional shape formed into a substantially half-circle. The inner peripheral edge portion of the edge 10 is fixed to the diaphragm 9, and the outer peripheral edge portion of the edge 10 is fixed onto the third flat part 4*c* of the frame 4.

The cap 11 is formed into a substantially circle shape (not shown) when planely observed, and is formed into a curved shape projecting on the upper surface side of the voice coil bobbin 7 when cross-sectionally observed. The outer peripheral edge portion of the cap 11 is mounted on the diaphragm 9 via an adhesive. The cap 11 has a function to prevent dust and foreign matter from entering the inner side of the speaker device 100.

In the above-mentioned speaker device 100, the electric signal outputted from the amplifier is outputted to the wire 8 of the voice coil via each of the terminal members 5, each of the tinsel cords 12 and each lead wiring. Thereby, the driving force is generated to the voice coil in the magnetic gap 16, which vibrates the diaphragm 9 in the axis direction of the speaker device 100. In this manner, the speaker device 100 irradiates an acoustic wave in the direction of an arrow Y1.

What is claimed is:

1. A voice coil bobbin formed by a titanium material which is produced by skinpass rolling of pure titanium, wherein the skinpass rolling is conducted to enhance its strength by cold rolling the pure titanium material such that the rolling ratio is equal to or larger than 60% after vacuum annealing as compared with pure titanium rolled as defined by JIS4600 in a process of rolling a material provided that the tensile strength and elasticity of the cold rolled titanium are both at least twice the hardness, tensile strength and elasticity according to the JIS No. 1 for titanium (TR270C), respectively.

2. A speaker device comprising a voice coil bobbin formed by a titanium material which is produced by skinpass rolling of pure titanium, wherein the skinpass rolling is conducted to enhance its strength by cold rolling the pure titanium material such that the rolling ratio is equal to or larger than 60% after vacuum annealing as compared with pure titanium rolled as defined by JIS4600 in a process of rolling a material provided that the tensile strength and elasticity of the cold rolled titanium are both at least twice the hardness, tensile strength and elasticity according to the JIS No. 1 for titanium (TR270C), respectively.

* * * * *